US006135852A

United States Patent [19]

Young

[11] Patent Number: 6,135,852

[45] Date of Patent: Oct. 24, 2000

[54] FOUNDATION GARMENT STRAP RETAINER

[76] Inventor: Natasha A. Young, 7932 Meadowbrook Dr., Indianapolis, Ind. 46240

[21] Appl. No.: 09/454,433

[22] Filed: Dec. 3, 1999

[51] Int. Cl.[7] ..... A41D 27/26

[52] U.S. Cl. ..... 450/86; 450/88; 450/1; 2/268

[58] Field of Search ..... 450/86, 188; 297/482, 297/488; 150/107, 110; 2/268, 267; 280/733, 751, 808; 224/643, 215, 264, 202, 907, 155

[56] References Cited

U.S. PATENT DOCUMENTS

| | | | |
|---|---|---|---|
| D. 298,386 | 11/1988 | Hirahara | D3/327 |
| D. 383,888 | 9/1997 | Smith . | |
| 2,633,573 | 4/1953 | Sanders | 2/268 |
| 2,643,380 | 6/1953 | Blair | 2/268 |
| 4,612,935 | 9/1986 | Greifer . | |
| 4,704,745 | 11/1987 | Reaver . | |
| 4,764,988 | 8/1988 | Reaver . | |
| 4,945,576 | 8/1990 | Melton | 2/460 |
| 5,060,348 | 10/1991 | Moshier . | |
| 5,172,428 | 12/1992 | Leinoff | 2/181 |
| 5,201,078 | 4/1993 | Melton | 2/268 |
| 5,308,278 | 5/1994 | Huang . | |
| 5,558,556 | 9/1996 | Froehlich . | |
| 5,566,871 | 10/1996 | Weintraub | 224/264 |
| 5,626,507 | 5/1997 | Gillen | 450/86 |
| 5,913,413 | 6/1999 | Huyck | 2/459 |

*Primary Examiner*—Gloria M. Hale
*Attorney, Agent, or Firm*—Woodard, Emhardt, Naughton Moriarty & McNett

[57] ABSTRACT

A retainer capable of retaining the strap of a foundation garment upon the shoulder of the wearer so as to conceal the strap and maintain it concealed under the outer garment. The retainer is an elongated sleeve having a base, two side walls and a split top, together defining a passageway for the strap. The retainer is of a single piece construction molded from a material having slip resistance in contact with human skin and with clothing materials. After placing a foundation garment strap through the split top into the passageway, the retainer is placed on an appropriate part of the body, generally on the shoulder, concealed by the outer garment of the wearer. The retainer clings to the body and to the outer garment and maintains its position during wear of the garment.

15 Claims, 5 Drawing Sheets

FOUNDATION GARMENT STRAP RETAINER

FIELD OF THE INVENTION

The present invention relates to accessories for apparel and more particularly to a retainer for confining the straps of foundation garments upon the shoulder and under the outer garments of the wearer.

BACKGROUND OF THE INVENTION

It is not uncommon for the straps of foundation garments to slide off the shoulder of the wearer. These straps when exposed from under the outer garments, which is particularly easy when the foundation garment is worn under a strapped outer garment or one that has a wide and/or deep neck opening, become a source of embarrassment. Additionally, if the straps slide down to the upper arm, they will restrict the arm movements of the wearer and become a source of discomfort.

Accordingly, there is a need for a device capable of retaining the straps of the foundation garments on the shoulder of the wearer and keeping them under the outer garment. Such a device should be small and thin so it can be easily hidden under outer garments of different styles. The device should also be easily engaged so as not to become a hassle for the wearer during her daily dressing routine. Ideally, the device should be a stand-alone type, which does not have to be permanently attached to a garment, so that one device could be used for many different garments. Furthermore, the device should be easily and inexpensively manufactured.

Various attempts have been made to meet the needs described. One prior art device uses two foldable flaps sewn to a base to retain a brassiere strap upon the shoulder of the wearer (U.S. Pat. No. 5,558,556). This device meets the stand-alone criteria, but is quite large and therefore limits the types of outer garments with which it can be used. Another prior art device uses a flexible string to retain the brassiere straps (U.S. Pat. No. 5,308,278). This device meets the size requirement, but has to be sewn onto the outer garment before use. Many other prior art devices employ VELCRO® type fasteners in various designs to retain the brassiere straps (U.S. Pat. No. 4,764,988, No. 4,704,745 and No. 5,060,384). These devices, in general, are quite bulky and complex to use. In addition, these retainers are designed to remain in place by hooking to the undersurface of the outer garment, hence causing unnecessary damage to the outer garment.

SUMMARY OF THE INVENTION

According to one embodiment of the present invention there is provided a retainer to engage and retain the straps of foundation garments with the goal of concealing them under the outer garments of the wearer. The retainer of the present invention is a stand-alone device ready for use after purchase without having to be affixed permanently to any particular garment so that the retainer can be used for many garments. Furthermore, the retainer is dimensioned to accommodate most foundation garment straps, but still small enough to be hidden by most outer garments.

The retainer of the present invention is an elongated sleeve having a base, two walls and a split top; together, they define a passageway within. The passageway is dimensioned to receive a foundation garment strap. The retainer is of a single piece construction molded from a material which resists slipping on human skin and clothing materials. In one embodiment, the retainer is molded from silicone rubber. After placing a foundation garment strap through the split top into the passageway, the retainer is placed on an appropriate part of the body, generally on the shoulder or off the shoulder for open-necked shirts or dresses, hidden from view by the outer garment of the wearer. The retainer clings to the body and to the outer garment and maintains its position during wear of the garment.

It is therefore an object of this invention to provide a retainer designed to engage and retain straps of foundation garments and which is capable of frictionally clinging to the body of the wearer and to the outer garment while remaining concealed under the outer garment of the wearer.

Another object of the present invention is to provide a foundation garment strap retainer that, after purchase, is ready for use without having to be permanently affixed to any garments.

DETAILED DESCRIPTION OF THE DRAWINGS

Figure 1:
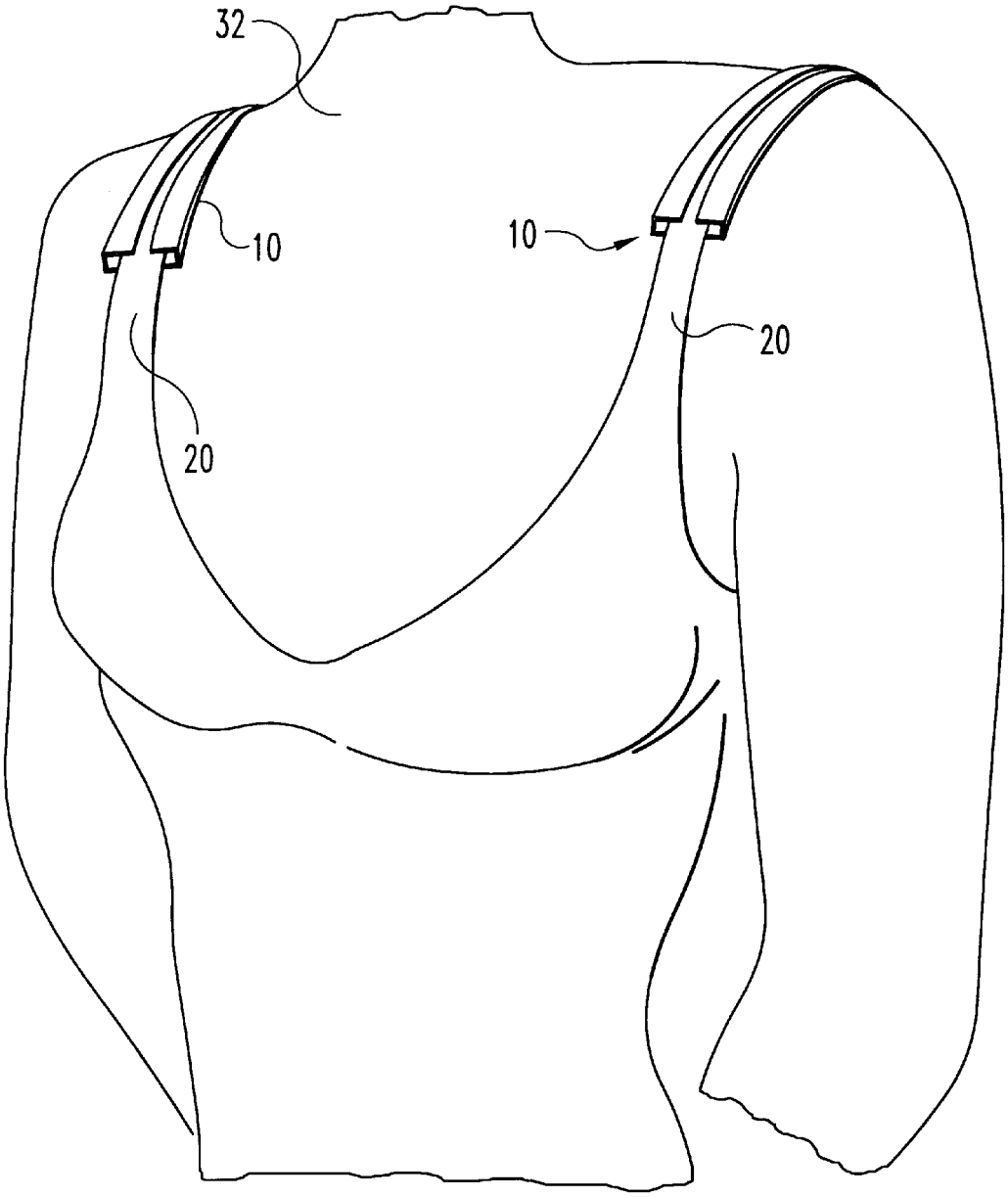
FIG. 1 is a front elevation of a woman wearing a brassiere having the straps contained in the foundation garment strap retainers of the present invention.

For the purpose of promoting an understanding of the principles of the invention, reference will now be made to the embodiment illustrated in the drawings and specific language will be used to describe the same. It will nevertheless be understood that no limitation of the scope of the invention is thereby intended, such as alterations and further modifications in the illustrated device, and such further applications of the principles of the invention as illustrated therein being contemplated as would normally occur to one skilled in the art to which the invention relates.

The present invention provides an improved device for retaining the straps of foundation garments upon the shoulder of the wearer. An example of the retainer designed for retaining brassiere straps is provided here for illustrative purposes. FIG. 1 shows the foundation garment strap retainers 10 retaining a pair of brassiere straps 20 on the shoulders of a woman 32. Retainer 10 is a stand-alone device, which does not need to be permanently attached to either the foundation garment or the outer garment to perform its intended function. Additionally, the retainer 10 is thin and small, so the outer garments of the wearer easily conceal it. As an example, the external dimensions of retainer 10 are approximately ⅝ inch wide, 5/32 inch high and 2½ inches long.

Figure 2:
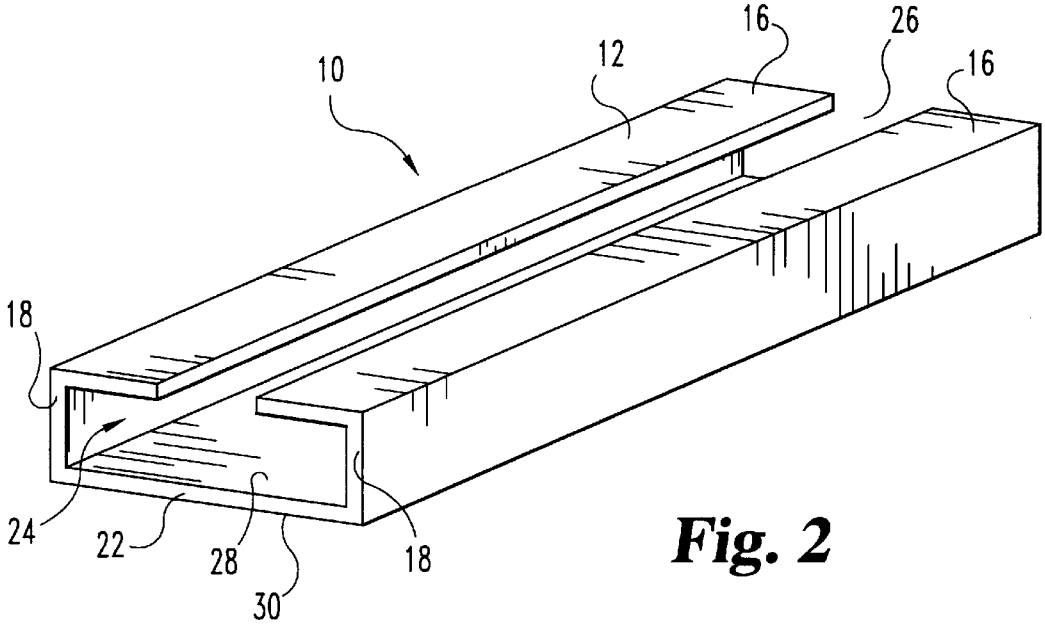
FIG. 2 is a perspective view of the foundation garment strap retainer with the top of the retainer facing up.

Referring particularly to FIG. 2, retainer 10 is an elongated sleeve which has a base 22, two side walls 18 and a split top 12 defining an elongated passageway 24 with open ends within which foundation garment strap 20 would be placed. Passageway 24 is dimensioned to accommodate the thickness and width of most foundation garment straps. In addition, the retainer is of adequate length to span over the shoulder of the wearer. It is believed preferable that passageway 24 is approximately 1/16 inch high, ½ inch wide and 2½ inches long, for example. The foregoing and following dimensions are given as preferred examples, but not precisely essential to the function of the retainer.

Figure 3:
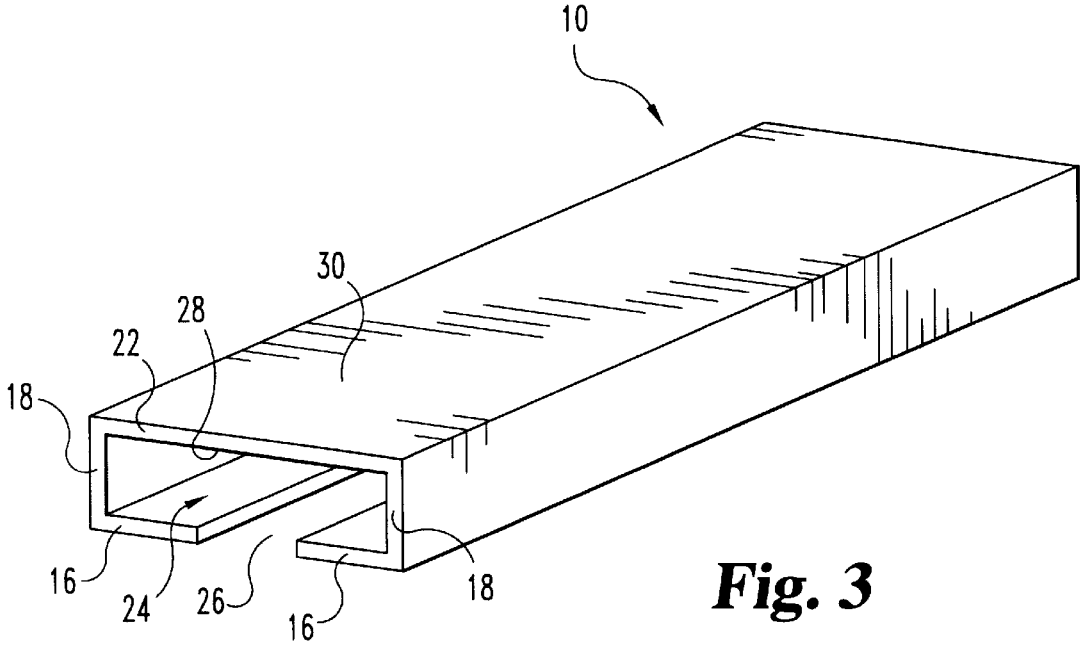
FIG. 3 is a perspective view of the foundation garment strap retainer, with the base of the retainer facing up.

Base 22 is of a thickness sufficient to impart reasonable transverse rigidity to the device without interfering with easy curving about axes transverse to the length of the device, for conformity to the shoulder of the wearer, thus avoiding bulges in an outer garment at the opposite ends of the retainer device. In the embodiment illustrated (shown upside down) in FIG. 3, base 22 is about 1/32 inch thick.

Base 22 has an upper surface 28 upon which a foundation garment strap 20 is placed and a bottom surface 30 that is in contact with the skin of the wearer 32. In one illustrated embodiment (shown upside down in FIG. 3), the bottom surface 30 is smooth, allowing maximum contact to enhance frictional adhesion to the body of the wearer. However, surface features may be disposed upon the bottom surface to achieve additional purposes, e.g. transverse ribs 36 and grooves 38 may be added to allow perspiration to escape from below the retainer (shown upside down in FIG. 4). Depending on the surface features chosen, the overall dimensions of the device may vary. In general, the differences are not substantial. For example, the transverse ribs 36 as shown add approximately 1/32 inch to the usual 1/32 inch thickness of base 22.

Two side walls 18 extend upward from base 22. In the illustrated embodiment, side wall 18 is preferably of a thickness adequate to remain erect while giving support to the split top 12. In addition, side wall 18 is preferably of a height allowing the passageway 24 to have a dimension adequate to accommodate the thickness of common foundation garment straps. In the illustrated embodiment, side walls 18 are approximately 1/16 inch thick and ⅛ to 5/32 inch overall height.

Split top 12 comprises two cantilevered opposing flaps 16, each of which is integrally attached to and carried by the top edge of the opposing side walls 18. The two opposing flaps 16 are sized, about ¼ inch wide to partially cover passageway 24, thus leaving a ⅛ inch wide gap 26 through which the foundation garment strap 20 is inserted into passageway 24. Furthermore, flaps 16 are of a thickness which balances the needs for durability required for repeated use and flexibility required for easy insertion of the foundation garment strap. In the example, flaps 16 are approximately 1/32 inch thick.

Figure 5:
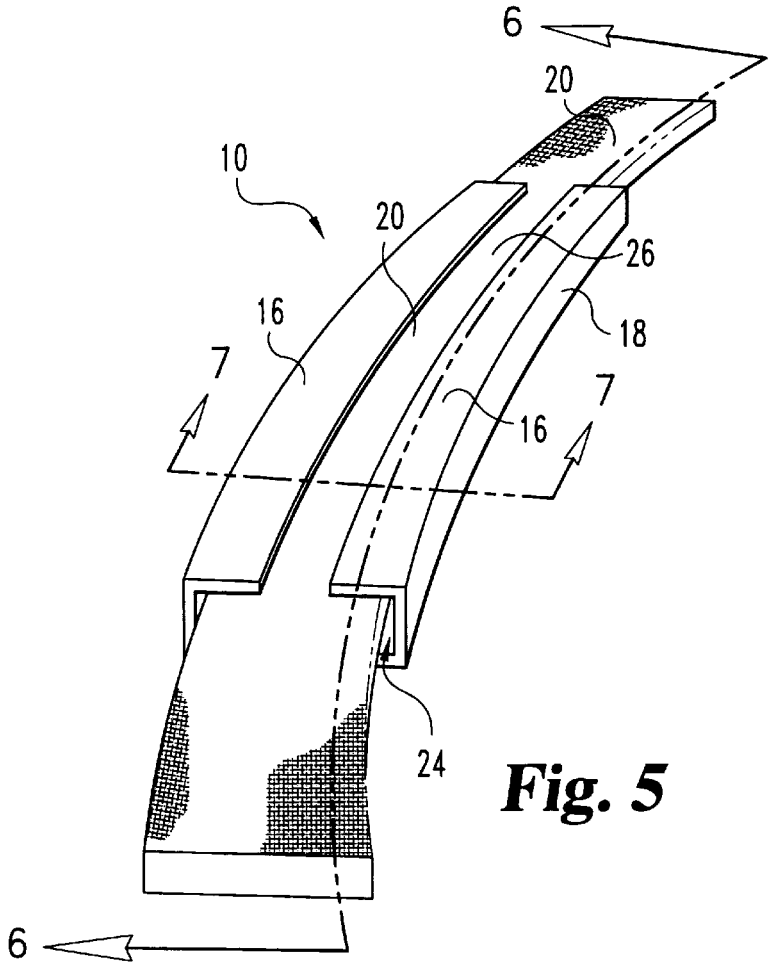
FIG. 5 is an enlarged view of the foundation garment strap retainer further illustrating how the foundation garment straps are retained.
Figure 6:
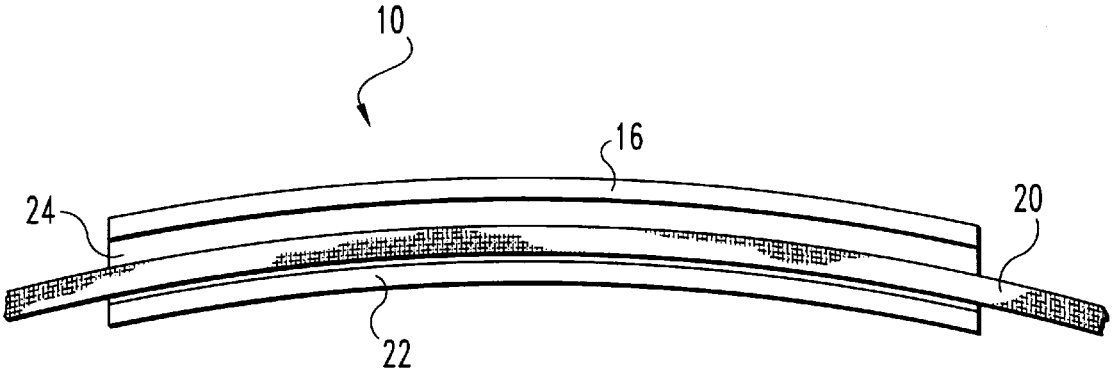
FIG. 6 is a sectional view taken along line 6—6 of FIG. 5 and viewed in the direction of the arrows, showing the foundation garment strap retainer retaining a strap.
Figure 7:
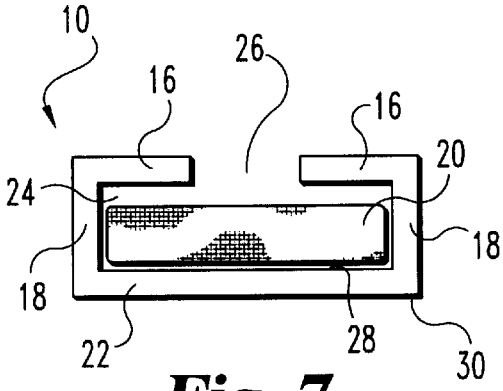
FIG. 7 is a cross sectional view taken along line 7—7 of FIG. 5 and viewed in the direction of the arrows, showing the foundation garment strap retainer retaining a strap.

FIGS. 5–7 show the retainer-garment strap combination assembled. Generally, the wearer may don the foundation garment first and then insert the strap 20 into passageway 24 of the retainer 10 through gap 26. The free ends of flaps 16 usually are lifted to facilitate the process. The assembled retainer and garment strap combination is placed, generally on the shoulder area, of the wearer. The retainers 10 then frictionally adhere to the body and maintain their positions, thus preventing the straps from slipping out of position. Additionally, the retainers also frictionally cling to the outer garment which is placed upon the retainer and so remains stationary on the brasierre. Therefore, the retainer can be used anywhere on the shoulder and enable the wearer to wear open necked shirts or dresses without the necessity for a strapless brassiere. This frictional adhesion results from the material of which the retainer is manufactured resisting slipping in contact with human skin and with clothing material. The retainer 10 may be formed from any materials, preferably natural or synthetic rubbers, possessing the slip resistance and sufficient flexibility and resilience for comfort and reusability. In one example, the retainer is of a one-piece construction molded from silicone rubber. An example of the rubber material is general purpose silicone rubber product #NPC40 of the Dow-Corning Corporation.

Figure 4:
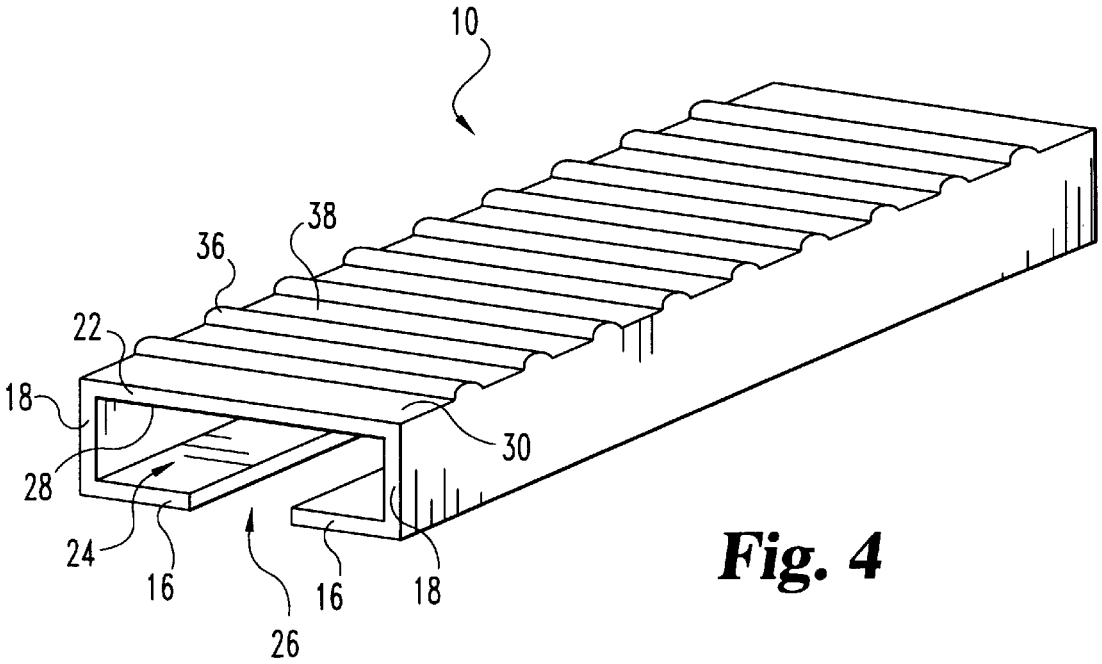
FIG. 4 is a perspective view of another embodiment of the foundation garment strap retainer having ribs and grooves on the bottom surface of the base.
Figure 8:
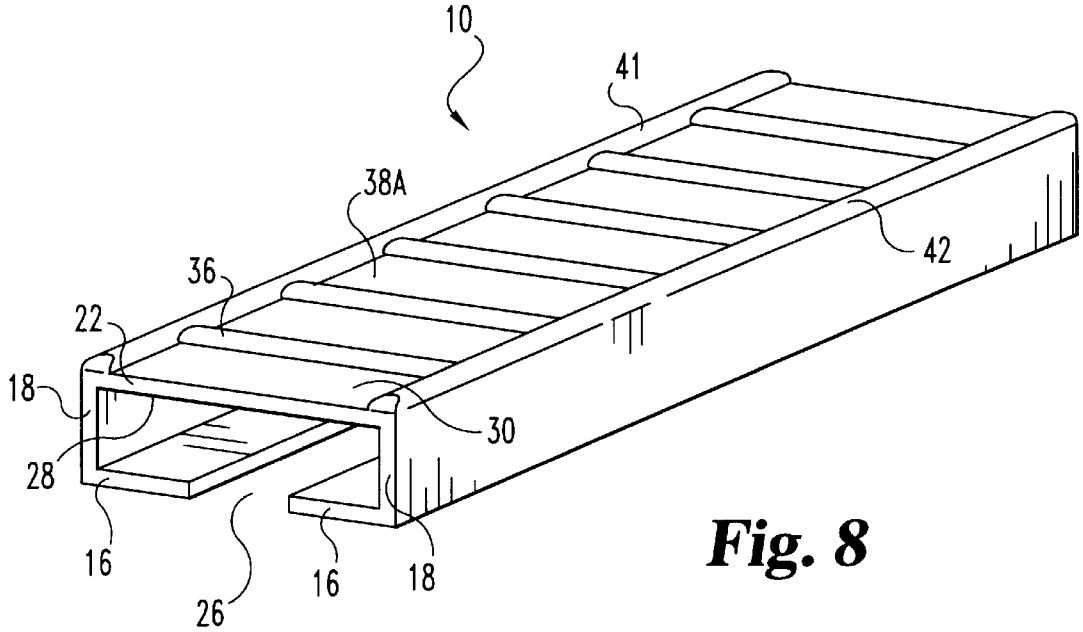
FIG. 8 is a bottom perspective similar to FIG. 4 but showing another embodiment with ribs framed rather than the open ended style of FIG. 4.
Figure 9:
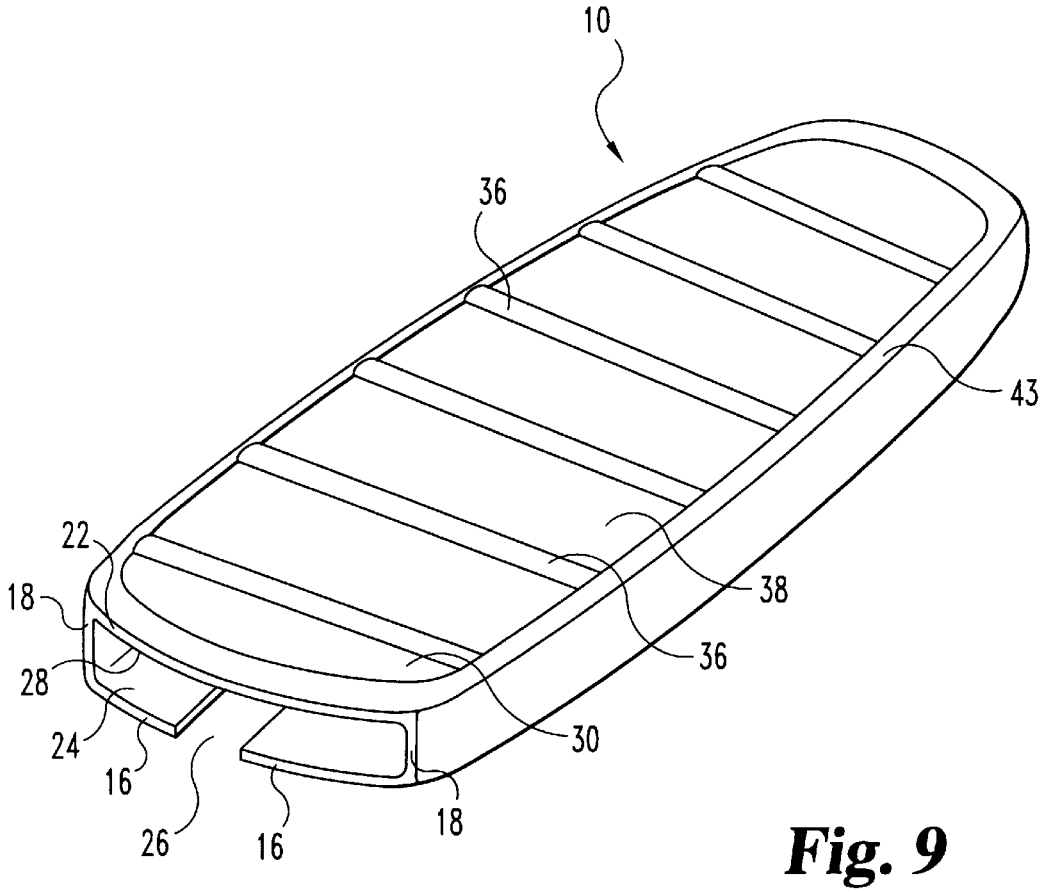
FIG. 9 is a bottom perspective view similar to FIG. 8 but showing a preferred exterior shape and bottom configuration similar to FIG. 8.

Referring now to FIG. 8, the construction and dimensions are the same as the previously described embodiment of FIG. 4 except that there are longitudinal extending ribs 41 and 42 along the sides of the retainer at the opposite ends of ribs 36, leaving recesses 38A instead of the grooves 38. FIG. 9 is a view similar to FIG. 8 but showing a preferred exterior shape and bottom configuration similar to FIG. 8. In this embodiment, the rib 43 extends entirely around the perimeter of the bottom surface.

What is claimed is:

1. A foundation garment strap retainer comprising:

an elongated sleeve having a base, two side walls and a split top, said base, said side walls, and said split top together defining an elongated passageway having open ends, said base having an upper surface and a lower surface wherein surface features may be disposed, said side walls being extended upward from opposing sides of said base, and being of sufficient thickness to remain erect while giving support to said split top, said split top comprises two cantilevered opposing flaps, wherein each of said flaps is integrally attached to and carried by opposing sides of said side walls, and wherein said flaps are sized to leave a gap inbetween whereby allowing the placement of a foundation garment strap through said gap into said passageway, said elongated sleeve being made of a resilient, flexible material possessing sufficient coefficient of friction with human skin and clothing materials to allow said elongated sleeve having said foundation garment strap retained in said passageway to cling to a wearer upon whose body said elongated sleeve is placed and, additionally, to the outer garment placed thereon, and said elongated sleeve being dimensioned so as to be hidden under outer garments and still allow said foundation garment strap to fit within said passageway.

2. The foundation garment strap retainer of claim 1, wherein said elongated sleeve is of a single piece construction.

3. The foundation garment strap retainer of claim 1, wherein said elongated sleeve is molded from silicone rubber.

4. The foundation garment strap retainer of claim 1, wherein the overall dimensions of said elongated sleeve are about ⅝ inch wide, 5/32 inch high and 2½ inches long.

5. The foundation garment strap retainer of claim 1, wherein the dimensions of said passageway are about 1/16 inch high, ½ inch wide and 2½ inches long.

6. The foundation garment strap retainer of claim 1, wherein said surface features disposed upon said lower surface of said base are smooth for maximum contact.

7. The foundation garment strap retainer of claim 1, wherein said surface features disposed upon said lower surface of said base are transverse ribs providing grooves for sweat dissipation.

8. The foundation garment strap retainer of claim 1, wherein said surface features disposed upon said lower surface of said base include transverse ribs, and longitudinally extending rib means at the ends of said transverse ribs.

9. The foundation garment strap retainer of claim 1, wherein said surface features disposed upon said lower surface of said base are transverse ribs, and a perimetrical rib having portions passing ends of said transverse ribs.

10. A foundation garment strap retainer comprising:

an elongated sleeve having a base, opposing side walls and a top, and said base is connected to said top by said opposing side walls, said base, said top and said side walls together defining an elongated passageway having open ends, said base having an upper surface and a lower surface wherein surface features may be disposed thereon, and said top comprises two opposing and longitudinally extending flaps, with a longitudinal edge of one flap spaced from and facing a longitudinal edge of the other flap, and a gap between said edges, wherein said flaps are flexible, enabling them to be lifted for insertion of said straps into said passageway, and said elongated sleeve being made of a resilient, flexible material possessing sufficient slip resistance in contact with human skin and clothing materials for allowing said elongated sleeve having said foundation garment strap retained in said passageway to cling to a wearer upon whose body said elongated sleeve is placed, and, additionally, to the outer garment placed thereon, and said elongated sleeve is dimensioned so as to be hidden under most outer garments and still allow said foundation garment strap to fit within said passageway.

11. The foundation garment strap retainer of claim 10, wherein said elongated sleeve is of a single piece construction.

12. The foundation garment strap retainer of claim 10, wherein said elongated sleeve is molded from silicone rubber.

13. The foundation garment strap retainer of claim 10, wherein said elongated sleeve is ⅝ inch wide.

14. The foundation garment strap retainer of claim 11, wherein said surface features disposed upon said lower surface of said base are smooth for maximum contact.

15. The foundation garment strap retainer of claim 11, wherein said surface features disposed upon said surface of said base are transverse ribs providing grooves for sweat dissipation.

* * * * *